US007988264B2

(12) United States Patent
Haluzak et al.

(10) Patent No.: US 7,988,264 B2
(45) Date of Patent: Aug. 2, 2011

(54) METHOD FOR FORMING A FLUID EJECTION DEVICE

(75) Inventors: Charles C. Haluzak, Corvallis, OR (US); Chien-Hua Chen, Corvallis, OR (US); Kirby Sand, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 12/822,897

(22) Filed: Jun. 24, 2010

(65) Prior Publication Data

US 2010/0259583 A1 Oct. 14, 2010

Related U.S. Application Data

(62) Division of application No. 11/677,340, filed on Feb. 21, 2007, now Pat. No. 7,766,462.

(51) Int. Cl.
*B41J 2/045* (2006.01)

(52) U.S. Cl. ..... 347/71

(58) Field of Classification Search ..... 347/68, 347/70–72; 29/890.1

See application file for complete search history.

(56) References Cited

U.S. PATENT DOCUMENTS

| | | | |
|---|---|---|---|
| 5,940,099 | A | 8/1999 | Karlinski |
| 6,481,074 | B1 | 11/2002 | Karlinski |
| 6,494,566 | B1 | 12/2002 | Kishino et al. |
| 6,766,567 | B2 | 7/2004 | Karlinski |
| 6,848,181 | B1 | 2/2005 | Silverbrook |
| 7,052,117 | B2 | 5/2006 | Bibi et al. |
| 7,155,823 | B2 | 1/2007 | Silverbrook |
| 2003/0131475 | A1 | 7/2003 | Conta |
| 2005/0109730 | A1 | 5/2005 | Silverbrook |
| 2005/0144781 | A1 | 7/2005 | Silverbrook |
| 2006/0012649 | A1 | 1/2006 | Sakaida |

FOREIGN PATENT DOCUMENTS

| | | |
|---|---|---|
| EP | 1693206 | 8/2006 |
| JP | 08001941 | 1/1996 |
| JP | 11028822 | 2/1999 |
| JP | 2005244090 | 9/2005 |

*Primary Examiner* — An Do

(57) ABSTRACT

A method of forming a fluid ejection device includes forming a pair of first glass layers and forming a second glass layer. Each first glass layer includes a first side and a second side with the second side defining a first fluid flow structure. The second glass layer includes a first side and a second side opposite the first side, with each respective first side and second side defining a second fluid flow structure. The second glass layer is bonded in a sandwiched position between the respective first glass layers with each respective second fluid flow structure of the second glass layer in fluid communication with the respective first fluid flow structure of the respective first glass layers to define a fluid flow pathway for ejecting a fluid.

14 Claims, 5 Drawing Sheets

METHOD FOR FORMING A FLUID EJECTION DEVICE

CROSS-REFERENCE TO RELATED APPLICATIONS

This Utility Patent Application is a divisional application of U.S. application Ser. No. 11/677,340, filed Feb. 21, 2007, now U.S. Pat. No. 7,766,462, which is incorporated herein by reference.

BACKGROUND

Widespread ownership of high quality printers has dramatically changed the office landscape. One aspect of today's printers that enables so many businesses and individuals to own and operate a high quality printer is the ease of replacing the ink supply or the ink printhead. Even large format printers used by graphics professionals and larger businesses permit the end-user to replace the ink supply or printhead.

Conventional techniques for constructing ink printheads for large format printing are well known. The ink printheads can be formed as a top shooter or a side shooter and are capable of operating in different piezoelectric print modes, such as a push mode or a shear mode. Most conventional printhead manufacturing techniques include forming a silicon core from a silicon wafer polished on both sides and then etching a pattern of nozzles and associated firing chambers onto each side of the silicon core. In one technique, the etching is accomplished via a deep reactive ion etching (DRIE) process, which limits design flexibility along the Z dimension (e.g. height). These conventional processes are quite time consuming and require many iterations of coating, exposing, and developing to achieve the final structure of nozzles and firing chambers on the silicon core. In addition, conventional printheads used for large format printers typically include layers made of dissimilar materials, which causes a mismatch in the coefficient of thermal expansion between the silicon core and the other materials bonded to the silicon core.

Because of the continuing strong demand for printheads, printer manufacturers are driven to achieve faster and better processes for manufacturing printheads.

DETAILED DESCRIPTION

Figure 1A:
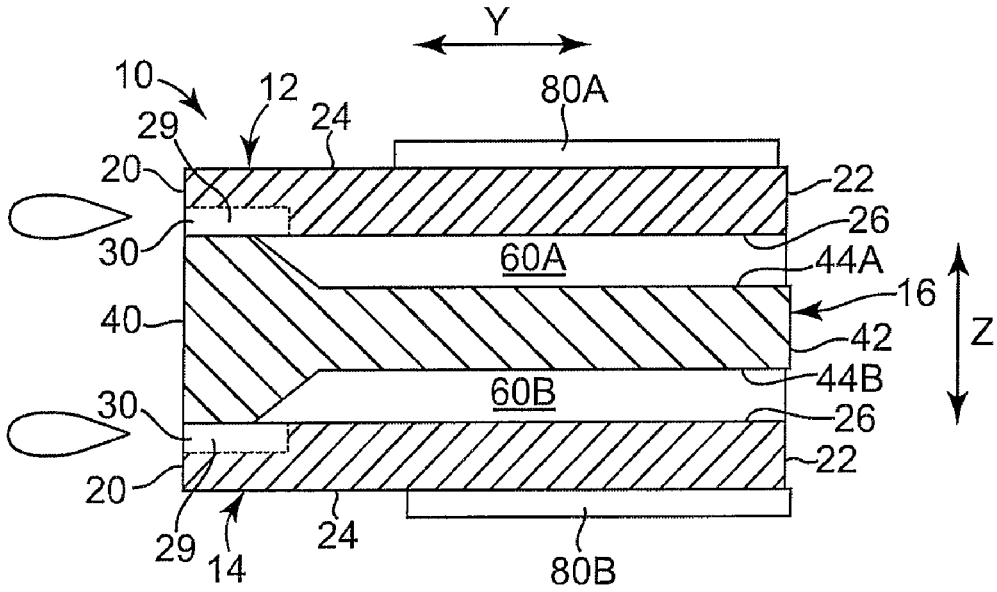
FIG. 1A is a sectional view of a fluid ejection device, according to an embodiment of the invention.

In the following detailed description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Embodiments of the invention are directed to a fluid ejection device and a method of making a fluid ejection device. In one embodiment, a fluid ejection device comprises a pair of outer glass layers and an inner glass layer (e.g., core). Each outer glass layer includes a first side defining a first fluid flow structure, including but not limited to, a first nozzle portion. The inner glass layer is sandwiched between, and bonded to, the respective outer glass layers. The inner glass layer includes two opposite sides with each respective side defining a second fluid flow structure, including but not limited to, a second nozzle portion and a firing chamber. The second nozzle portion of the inner glass layer and the first nozzle portion of the outer glass layer together form a nozzle of the fluid ejection device while the firing chamber on the respective opposite sides of the inner glass layer is in fluid communication with the first nozzle portion of the respective outer glass layers and with the second nozzle portion of the inner glass layer.

In one embodiment, the fluid ejection device comprises a printhead while, in another embodiment, the fluid ejection device comprises a side shooter type of a printhead of a large format printer.

In a method of forming a fluid ejection device, an inner layer is molded or macro-machined from a glass material as single piece defining one or more fluid flow structures protruding from the opposite sides of the inner layer. In one embodiment, the fluid flow structures of the inner glass layer comprise a firing chamber, a nozzle portion, a back-flow restrictor portion, ink feed channel, or a particle tolerant structure. In another embodiment, each outer glass layer is molded or micro-machined from a glass material as single piece defining one or more fluid flow structures protruding from the side of the outer glass layer(s). In one embodiment, the fluid flow structures of the outer glass layers comprise a nozzle portion, a back-flow restrictor portion, or an ink feed channel.

Machining or molding an inner glass layer and the outer glass layers with the desired fluid flow structures to form the fluid ejection device avoids the conventional painstaking, repetitious and iterative process of etching the structures onto the sides of a silicon wafer. In addition, with embodiments of the invention, a nozzle portion of the fluid ejection device (as well as other fluid flow structures) is formed as part of the outer glass layers rather than formed entirely on an inner layer (as conventionally occurs with silicon core printheads). This arrangement allows the inner layer to be formed with relatively looser tolerances, thereby reducing the cost of production, while the outer layers are formed separately with more exacting tolerances.

These embodiments, and additional embodiments, are described more fully in association with FIGS. 1A-7.

Figure 1B:
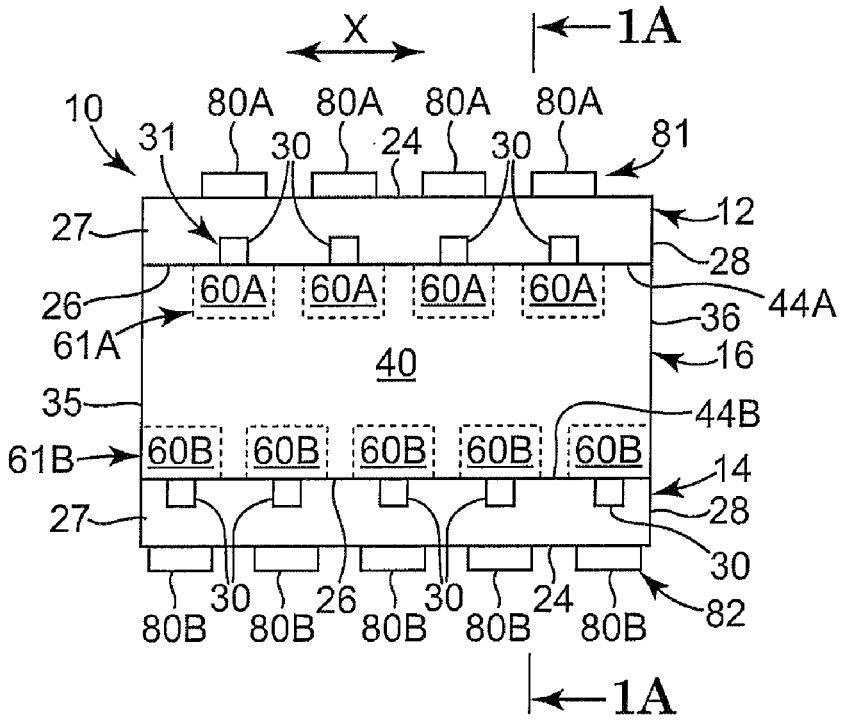
FIG. 1B is an end plan view of a fluid ejection device, according to an embodiment of the invention.

FIG. 1A is a sectional view of a fluid ejection device 10, according to an embodiment of the invention, as taken along lines 1A-1A of FIG. 1B. As illustrated in FIG. 1A, in one embodiment, fluid ejection device 10 comprises a first outer glass layer 12, a second outer glass layer 14, and an inner glass layer 16. Each first outer layer 12 and second outer layer 14 comprise a first end 20, a second end 22, a first side 24 and a second side 26 with second side 26 including a nozzle portion 29. The first side 24 is opposite from the second side 26. In another aspect, inner layer 16 comprises first end 40, second end 42, first side 44A and second side 44B with the second side 44B opposite the first side 44A.

When assembled as illustrated in FIG. 1A, second side 26 of outer layer 12 and first side 44A of inner layer 16 defines a firing chamber 60A while second side 26 of outer layer 14 and second side 44B of inner layer 16 defines a firing chamber 60B. In another aspect, when assembled as illustrated in FIG. 1A, nozzle portion 29 of each respective first and second outer layer 12, 14 in combination with the inner layer 16 defines the respective nozzles 30 of fluid ejection device 10. In one aspect, adjacent first end 40 of inner layer 16, firing chambers 60A, 60B are in fluid communication with nozzle 30 of fluid ejection device 10. In another aspect, except for their point of fluidic communication, the respective firing chambers 60A, 60B are longitudinally spaced apart from the respective nozzles 30 in a first direction (as represented by directional arrow y).

In another embodiment, a piezoelectric driver 80A is mounted onto first side 24 of first outer layer 12 while a piezoelectric driver 80B is mounted on to first side 24 of first outer layer 14. Accordingly, in use, ink flows from an ink feed channel (shown in FIGS. 3-7) into firing chambers 60A, 60B respectively and then is ejected via actuation of piezoelectric drivers 80A, 80B, respectively, through nozzles 30 of fluid ejection device 10.

In one aspect, this fluid ejection device is a drop-on-demand side-shooter piezoelectric printhead.

FIG. 1B is an end view of the fluid ejection device 10, according to an embodiment of the invention. As illustrated in FIG. 1B, inner layer 16 comprises a first side 44A and a second side 44B opposite the first side 44A, as well as a third side 35 and a fourth side 36. In another aspect, inner layer 16 also defines an end 40. Each respective outer layer 12, 14 comprises first side 24 and second side 26, as well as a third side 27 and a fourth side 28.

As illustrated in FIG. 1B, inner layer 16 also comprises an array 61A of firing chambers 60A (as represented by dashed lines since the firing chambers 60A are hidden from view) arranged in series on first side 44A of inner layer 16 and laterally spaced apart from each other in a second direction (as represented by directional arrow x) in a side-by-side relationship. In one aspect, the second direction is generally perpendicular to the first direction (shown in FIG. 1A). In addition, inner layer 16 also comprises an array 61B of firing chambers 60B (with each firing chamber 60B represented by dashed lines since the firing chambers 60B are hidden from view) arranged in series on second side 44B of inner layer 16 and laterally spaced apart from each other in the second direction (as represented by directional arrow x) in a side-by-side relationship.

In one aspect, fluid ejection device 10 comprises an array 31 of nozzles 30 arranged in series on second side 26 of outer layer 12 and laterally spaced apart from each other in the second direction (as represented by directional arrow x) in a side-by-side relationship. The nozzles 30 are spaced apart by a distance generally corresponding the lateral spacing between respective firing chambers 60A, 60B of inner layer 16 to align each respective nozzle 30 with a respective firing chamber 60A of the first side 44A of the inner layer 16 or with a respective firing chamber 60B of the second side 44B of the inner layer 16.

Each pair of a respective nozzle 30 and a respective firing chamber 60A (or firing chamber 60B) defines a fluid ejection unit of the fluid ejection device 10.

As further illustrated in FIG. 1B, fluid ejection device 10 comprises an array 82 of piezoelectric drivers 80B arranged in series on first side 24 of outer layer 14 and laterally spaced apart from each other in the second direction (as represented by directional arrow x) in a side-by-side relationship. Each piezoelectric driver 80B is positioned vertically above an associated firing chamber 60B of inner layer 16 to further define one of the fluid ejection units of fluid ejection device 10.

As further illustrated in FIG. 1B, fluid ejection device 10 comprises an array 81 of piezoelectric drivers 80A arranged in series on first side 24 of outer layer 12 and laterally spaced apart from each other in the second direction (as represented by directional arrow x) in a side-by-side relationship. Each piezoelectric driver 80A is positioned vertically above an associated firing chamber 60A of inner layer 16 to further define one of the fluid ejection units of fluid ejection device 10.

Figure 2:
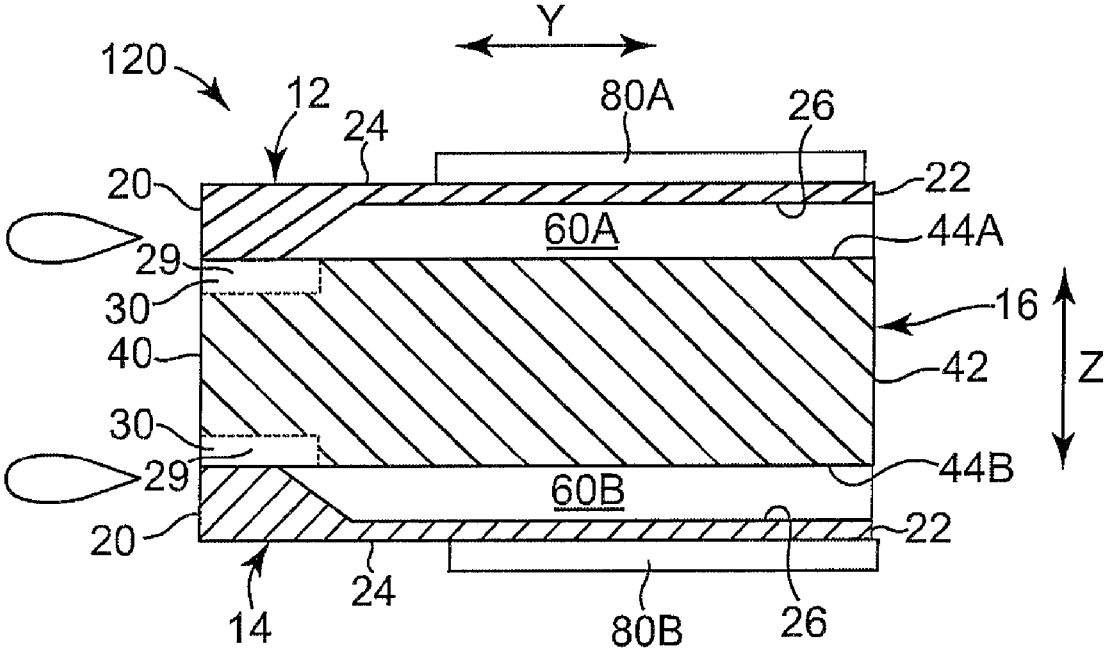
FIG. 2 is a sectional view of a fluid ejection device, according to an embodiment of the invention.

FIG. 2 illustrates a fluid ejection device 120, according to another embodiment of the invention. As illustrated in FIG. 2, in fluid ejection device 120 the placement of nozzle portions 29 and firing chamber 60A, 60B is reversed from the configuration shown in FIG. 1A so that in fluid ejection device 120, nozzle portion 29 is primarily formed on the first and second sides 44A, 44B of the inner layer 16 (instead of on second side 26 of outer layers 12, 14) and each respective firing chamber 60A, 60B is primarily formed on the second side 26 of the respective outer layers 12,14 (instead of on the first and second sides 44A, 44B of inner layer 16). Accordingly, a position of a fluid flow structure on the outer layers 12, 14 is exchanged with a position of a fluid flow structure on the inner layer 16. In all other respects, this fluid ejection device 120 illustrated in FIG. 2 comprises substantially the same features and attributes as fluid ejection device 10, as previously described and illustrated in association with FIGS. 1A-1B. Finally, this reversal of the position of the fluid flow structures of the inner layer relative to the fluid flow structures of the outer layers is applicable to other types of fluid flow structures (e.g., back-flow restrictors, particle filters, etc.) of the fluid ejection devices described and illustrated later in association with FIGS. 3-7.

In one embodiment, fluid ejection device 10 of FIGS. 1A, 1B, and 2 is formed according to the methods described in association with FIGS. 3-7. In another embodiment, fluid ejection device 10 of FIGS. 1A, 1B, and 2 comprises one or more of the additional structures described in association with FIGS. 3-7

Figure 3:
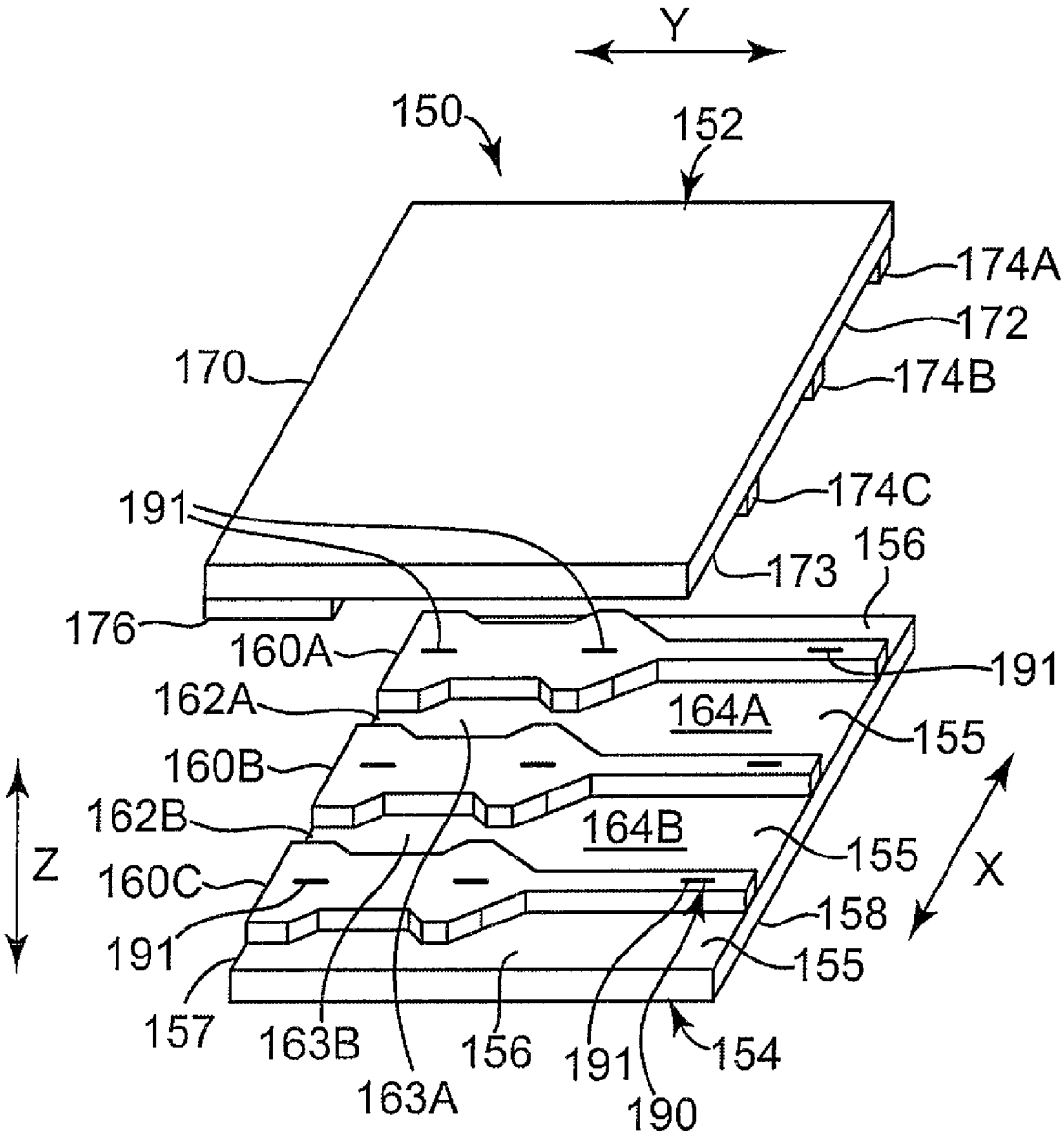
FIG. 3 is an exploded assembly view of a portion of a fluid ejection device, according to an embodiment of the invention.

FIG. 3 is an exploded perspective view of a fluid ejection device 150, according to one embodiment of the invention. In one embodiment, fluid ejection device 150 comprises substantially the same features and attributes as fluid ejection device 10 previously described in association with FIGS. 1A, 1B and 2. As illustrated in FIG. 3, in one embodiment, fluid ejection device 150 comprises an outer glass layer 152 and inner glass layer 154. In one aspect, inner layer 154 comprises first side 156 that includes nozzle portions 162A,162B, firing chambers 163A,163B, and ink feed channels 164A and 164B arranged in series (and generally parallel to each other) along the first direction (as represented by directional arrow y). In one aspect, barriers 160A, 160B, and 160C of first side 156 of inner layer 154 extend vertically upward in a third direction (as represented by directional arrow z) from generally flat portion 155. In one aspect, the spaces between the laterally spaced apart (along the second direction, x) barriers 160A, 160B, 160C defines respective nozzle portions 162A, 162B, respective firing chambers 163A, 163B, and respective ink feed channels 164A, 164B.

In another aspect, as illustrated in FIG. 3, outer layer 152 comprises a first end 170 and a second end 172. First end 170 of outer layer 152 is generally positioned above a first end 157 of inner layer 152 and a second end 172 of outer layer 152 is generally positioned above a second end 158 of inner layer 154. In another aspect, outer layer 152 comprises an array of barriers 174A, 174B, and 174C, that extend downward from first side 173 of outer layer 152 and that are laterally spaced apart from each other in the second direction (as represented by directional arrow x) to be positioned vertically above and in alignment with barriers 160A, 160B, 160C of inner layer 154. Accordingly, when first layer 154 and second layer 152 are assembled together (in a manner consistent with fluid ejection device 10 shown in FIGS. 1A, 1B, and 2), the respective barriers 174A, 174B, 174C and respective barriers 160A, 160B, 160C define a boundary between laterally adjacent fluid ejection units of fluid ejection device 150.

In one embodiment, as illustrated in FIG. 3, each outer layer 152 and inner layer 154 comprises an array 190 of targets 191 used to align the respective outer layer 152 and inner layer 154 to insure proper engagement relative to each other when bonding the inner layer 154 relative to the outer layer 152. In one aspect, the targets 191 are not strictly limited to the locations or quantities shown in FIG. 3, but are deposited in other positions as necessary and using more or less targets 191 as necessary to achieve proper alignment of the respective outer layers 152 and inner layer 154.

In another embodiment, as illustrated in FIG. 3, outer layer 152 additionally comprises a nozzle structure 176 positioned at first end 170 of outer layer 152 that extends downwardly for reciprocally engaging with respective barriers 160A, 160B, 160C and respective nozzle portions 162A, 162B of inner layer 154, thereby defining an array of nozzles of a fluid ejection device.

In one aspect, the outer layer 152 including nozzle structure 176 and/or walls 174A, 174B, 174C, is formed via micromachining or molding to produce the outer layer as a single piece of glass material. The ability to form nozzle structure 176 on outer layer 152, instead of on inner layer 154, enables nozzle portions 162A, 162B of inner layer 154 to be formed with a generally simpler construction than a nozzle portion of an inner layer of a conventional printhead having a silicon-based inner layer. These features and attributes related to forming an outer glass layer and an inner glass layer of a fluid ejection device, according to embodiments of the invention, are described further in association with FIGS. 4-7. In one embodiment, nozzle structure 176 is further described and illustrated as nozzle protrusion 252 of outer glass layer 212 of fluid ejection device 200 in FIG. 4.

Figure 4:
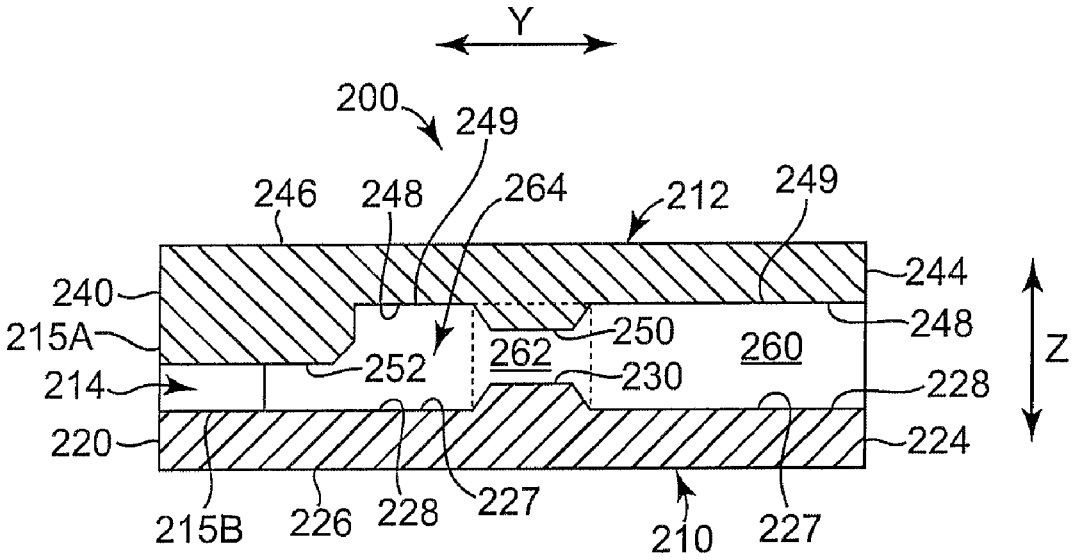
FIG. 4 is a sectional view of a fluid ejection device, according to an embodiment of the invention.

FIG. 4 is a sectional view illustrating a fluid ejection unit 200 of a fluid ejection device, according to one embodiment of the invention. In one embodiment, fluid ejection unit 200 comprises substantially the same features and attributes as fluid ejection device 10 as previously described in association with FIGS. 1A, 1B, and 2. As illustrated in FIG. 4, fluid ejection unit 200 comprises an outer layer 212 and an inner layer 210. In one aspect, inner layer 210 comprises first end 220 and second end 224, as well as first side 226 and second side 228 opposite the first side 226. Outer layer 212 comprises first end 240 and second end 244, as well as first side 246 and second side 248 opposite the first side 246.

As illustrated in FIG. 4, fluid ejection unit 200 comprises a nozzle 214 including a nozzle portion 215A of outer layer 212 and a nozzle portion 215B of inner layer 210. The nozzle portion 215A is part of a larger nozzle protrusion 252 of outer layer 212 that protrudes downwardly from a generally flat portion 249 of second side 248 of outer layer 212 toward nozzle portion 215B on second side 228 of inner layer 210. A firing chamber 264 is in fluid communication with nozzle 214 and is defined between second side 228 of inner layer 210 and second side 248 of outer layer 212 (in the region proximal to the nozzle 214). An ink feed channel 260 is in fluid communication with firing chamber 264, via a back-flow restrictor 262, and is defined between second side 228 of inner layer 210 and second side 248 of outer layer 212 (in the region proximal to the firing chamber 264).

In one aspect, back-flow restrictor 262 is defined by: (1) a protrusion 230 extending upward along the third direction (as represented by directional arrow z) from a generally flat portion 227 on first side 228 of inner layer 210; and (2) a protrusion 250 extending downward along the third direction (as represented by directional arrow z) from the generally flat portion 249 on second side 248 of outer layer 212. In one aspect, back-flow restrictor 262 defines a gap having a cross-sectional area generally narrower than a cross-sectional area of the ink feed channel 260 and generally narrower than a cross-sectional area of the firing chamber 264.

In one aspect, the relatively smaller gap defined by back-flow restrictor 262 limits ink from blowing back into ink feed channel 260 from firing chamber 264 upon actuation fluid ejection device 10 to eject ink from nozzle 241.

In one aspect, outer glass layer 212 (including fluid flow structures such as back-flow protrusion 250 and nozzle protrusion 252) is formed via micro-machining, to produce the outer glass layer as a single piece of glass material. This single piece formation of fluid ejection unit 200 simplifies construction of inner layer 210 by locating at least a portion of the structure of nozzle 241 on the outer layer 212 instead of substantially entirely on a silicon core layer as occurs in the formation of conventional printheads.

Figure 5:
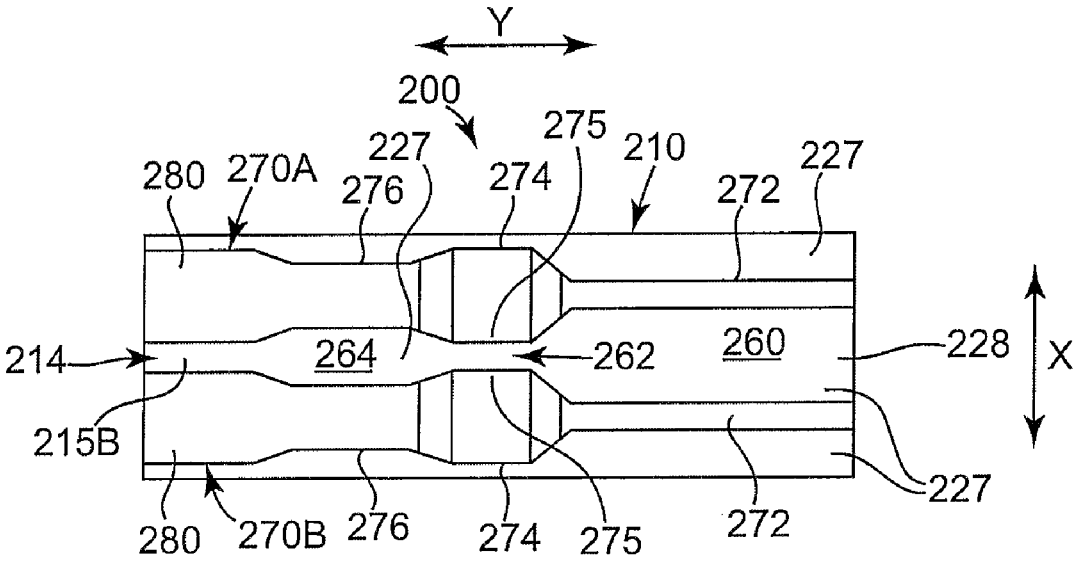
FIG. 5 is a top plan view of a portion of a fluid ejection device, according to an embodiment of the invention.

FIG. 5 is a top plan view of the inner layer 210 of fluid ejection unit 200 of FIG. 4, according to one embodiment of the invention. As illustrated in FIG. 5, inner layer 210 comprises barriers 270A and 270B which are laterally spaced apart from each other in the second direction (as represented by directional arrow x) on second side 228 of inner layer 210 to define nozzle portion 214, firing chamber 264, back-flow restrictor 262, and ink feed channel 260 (aligned in series along a length of the fluid ejection unit). Each barrier 270A, 270B protrudes upwardly from generally flat portion 227 of second side 228 of inner layer 210.

In one embodiment, as illustrated in FIG. 5, each respective barrier 270A, 270B comprises ink feed portion 272, restrictor portion 274, firing chamber portion 276, and nozzle portion 280. In one aspect, ink feed portion 272 of barriers 270A, 270B is relatively narrow to cause ink feed channel 260 of inner layer 210 to be generally wide while nozzle portion 280 of barriers 270A, 270B is relatively wide to cause nozzle portion 214 of inner layer 210 to be relatively narrow.

In another aspect, restrictor portion 274 of barriers 270A, 270B is relatively wide to cause back-flow restrictor 262 of inner layer 210 to be generally narrow to prevent blow back of ink from firing chamber 264 of inner layer 210. As illustrated in FIG. 5, an inner side 275 of the respective restrictor portions 274 of barriers 270A, 270B extend laterally toward each other (along the second direction as represented by directional arrow x) to further define the back-flow restrictor 262 of inner layer 210. In another aspect, firing chamber portion 276 of barriers 270A, 270B is narrower than nozzle portion 280 and narrower than the restrictor portion 274 of barriers 270A, 270B, thereby enabling firing chamber 264 to hold a sufficient volume of ink for each actuation of the fluid ejection unit 200.

Figure 6:
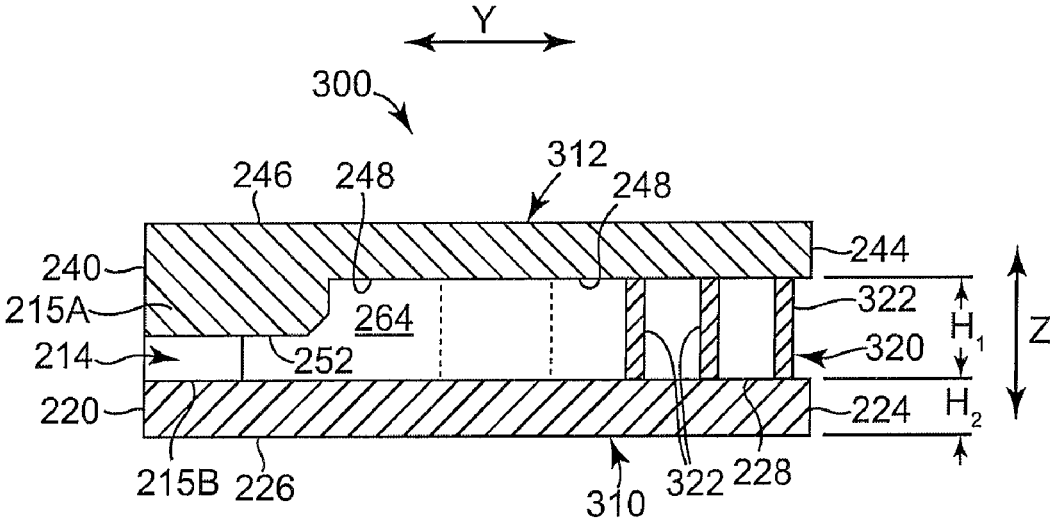
FIG. 6 is a sectional view of a fluid ejection device, according to an embodiment of the invention.

FIG. 6 is a sectional view of a fluid ejection unit 300 of a fluid ejection device, according to one embodiment of the invention. In one embodiment, fluid ejection unit 300 comprises substantially the same features and attributes as fluid ejection device 10 as previously described in association with FIGS. 1A, 1B, and 2. In another embodiment, fluid ejection unit 300 illustrated in FIGS. 6-7 comprises substantially the same features and attributes as fluid ejection unit 200 (of FIGS. 4-5), except omitting back-flow restrictor 262 and then additionally comprising a different fluid flow structure, such as a particle filter 320. As illustrated in FIG. 6, fluid ejection unit 300 comprises inner glass layer 310 and outer glass layer 312. In one aspect, inner layer 310 comprises first end 220, second end 224, first side 226 and second side 228 while outer layer 312 comprises first end 240, second end 244, first side 246 and second side 248. Outer layer 312 also comprises nozzle protrusion 252.

In one aspect, as illustrated in FIG. 6, particle filter 320 comprises an array of columns 322 that extend vertically upward from second side 228 of inner layer 310. Particle filter 320 is positioned between, and extends vertically between, inner layer 310 and outer layer 312 near second end 244 of outer layer 312 and second end 224 of inner layer 310. In one aspect, columns 322 extend generally vertically in the third direction (as represented by directional arrow z). In another aspect, columns 322 of particle filter 320 are longitudinally spaced apart in the first direction (as represented by directional arrow y) from second end 224 of inner layer 310 (and second end 244 of outer layer 312) toward the first end 220 of inner layer 310 (and first end 240 of outer layer 312) of fluid ejection unit 300.

In one aspect, particle filter 320 comprises a particle tolerant architecture (PTA) to prevent unwanted particles from entering the firing chamber or nozzle portion of a fluid ejection device.

In another aspect, particle filter 320 is located in the region corresponding to ink feed channel 260 (FIG. 7) and/or is located in the region corresponding to firing chamber 264.

Figure 7:
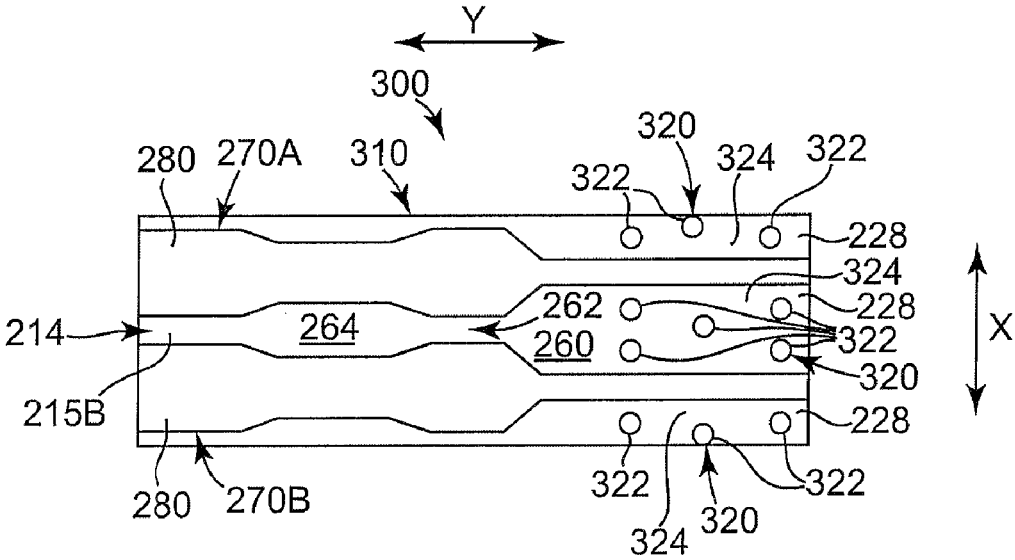
FIG. 7 is a top plan view of a portion of a fluid ejection device, according to an embodiment of the invention.

FIG. 7 is a top plan view of inner layer 310, according to one embodiment of the invention. In one embodiment, inner layer 310 comprises substantially the same features and attributes as inner layer 210 as previously described in association with FIG. 5, except additionally including particle filter 320. In another aspect, as illustrated in FIG. 7, particle filter 320 is positioned between adjacent barriers 270A, 270B of inner layer 310 so that the respective columns 322 of particle filter 320 are laterally spaced apart from each other in the second direction (as represented by directional arrow x), as well as being longitudinally spaced apart from each other in the first direction (as represented by directional arrow y). In one aspect, these lateral and longitudinal spaces are represented by indicator 324.

In embodiment, inner layer 310 is formed (via macro-machining or double sided molding) in which the entire inner layer 310, including columns 322 and other structures of the inner layer 310, are formed as a single piece of glass material. Accordingly, columns 322 of particle filter are formed simultaneously with the other portions of inner layer 310 during formation of inner layer 310. In one aspect, columns 322 have a height (represented by H1 in FIG. 6) substantially greater than a height of inner layer 310 (represented by H2 in FIG. 6).

In one embodiment, the glass layers described in association with FIGS. 1A-7 are formed via molding. In one aspect, inner glass layers (e.g., inner glass layer 16, 210, 310, respectively) are molded as one piece via a double sided thermal glass molding technique available, for example, through Berliner Glas GMBH of Germany. Accordingly, the fluid flow structures (i.e., surface topology) of the inner glass layers are formed in one molding step rather than conventional techniques of attaching surface structures to a flat base layer. In this way, a fluid flow structure such as a barrier (e.g., barrier 270A or 270B) of an inner glass layer and/or a particle filter 320 in embodiments of the invention are simultaneously formed.

In another aspect, outer glass layers (e.g., outer glass layer 12, 212, 312, respectively) are molded as one piece via a glass molding technique available, for example, through Berliner Glas GMBH of Germany. Accordingly, the fluid flow structures of the outer glass layers are formed in one molding step rather than conventional techniques of attaching surface structures to a flat base layer or a conventional technique of using a completely flat glass cap. In this way, a fluid flow structure such as a nozzle protrusion 252 of an outer glass layer (in FIG. 4 or 6) and/or a flow restrictor portion 250 (in FIG. 4) in embodiments of the invention are simultaneously formed as part of forming the entire outer glass layer.

In one embodiment, the molded inner layer and the molded outer layers are bonded to one another via plasma bonding, anodic bonding, silicate bonding or another suitable bonding technique. In one example, to perform anodic bonding of the all glass inner layer and outer layers, a preparatory bonding material, such as a thin poly or amorphous silicon layer is blanket deposited onto the bonding side of the inner layer and of the respective outer layers to enable the anodic bonding to take place. In another example, to perform the plasma bonding technique, a preparatory bonding material such as a thin, planarized tetraethyl orthosilicate (TEOS) layer is deposited on each respective outer layer and the inner layer to enable the plasma bonding to take place.

In another embodiment, the inner layer is formed via macro-machining using wet etching, dry etching (plasma based), plunge-cut sawing, ultra-sonic milling, powder-blasting, or other macro-machining processes. In another embodiment, the outer layer is formed via micro-machining to attain a precision, repeatable nozzle (or bore) using wet etching, dry etching (plasma based), or by a Novolay™ process available from Schott (Schott Electronics GmbH, Berlin & Dresden, Germany).

In one aspect, machining of the first glass layer and the second glass layer is greatly simplified because both the first layer and the second layer are formed of the same material. Accordingly, in one embodiment, the same saw blade is used to saw or machine both the first glass layers and the second glass layer. In another embodiment, the same computer-based saw control program is used to direct the saw in machining both the first glass layers and the second glass layers. This arrangement avoids the more complex and expensive conventional method of using different saw blades and/or using different saw control programs (e.g., different blade-rotation parameters, different feed-rates, etc.) that are used when an outer cap or layer is made of a glass material and the core (or inner layer) is made of a silicon material because the different types of materials (i.e., glass v. silicon) require different machining techniques.

In another embodiment, the first fluid flow structures (e.g., nozzle portion 29 in FIG. 1A) of the outer glass layers of a fluid ejection device are formed on a first scale of magnitude while the fluid flow structures (e.g., firing chamber 60A, 60B in FIG. 1A) of the inner glass layer are formed on a second scale of magnitude that is at least one order of magnitude greater than the first scale of magnitude. This arrangement is possible because of the generally looser tolerances applied to form larger fluid flow structures, such as the firing chamber, as compared to the generally tighter tolerances applied forming the nozzle portions.

In another aspect of embodiments of the invention, because the respective first outer layers and the second inner layer are made of the same material, i.e., glass, a more uniform nozzle of the respective fluid ejection units is formed, which results in a more uniform "drop" formation by the nozzles. This arrangement is in contrast to the conventional situation in which the nozzle of a fluid ejection unit is composed of two different materials (i.e., silicon and glass), which sometimes have different "chip" behavior when machined and therefore which can lead to drop mis-formation by the nozzle of the fluid ejection unit.

In another aspect of embodiments of the invention, because the first outer layers and the second inner layers are made of the same material (i.e., glass), the respective first outer layers and second inner layer exhibit more symmetric wetting behavior because the surface chemical nature of the glass of the outer layers and inner layers is substantially the same. This arrangement is in contrast to the conventional arrangement of the dissimilar materials of glass and silicon, which sometimes leads to asymmetric fluidic wetting around a nozzle of a fluid ejection unit, and which negatively affects the reliability of the nozzle (e.g., plugging and surface junk contamination). Ultimately, these phenomena negatively affect a drop trajectory of the nozzle of the fluid ejection unit, which results in lower quality printing.

In another aspect, a target is placed on each of the outer layers and on the inner layers for alignment of the respective layers, as previously described in association with FIG. 3.

Moreover, because the outer glass layers are formed separately from the inner glass layer, the fluid flow structures (e.g., a nozzle protrusion 252 or back-flow restrictor portion 250) of the outer glass layer are formed without having to simultaneously control tolerances of the fluid flow structures of the firing chamber of the inner glass layer. This arrangement is in contrast to conventional silicon-based printhead manufacturing techniques in which both a nozzle and a firing chamber (each having dimensions that are orders of magnitude difference) must be etched on the same silicon wafer core.

In another aspect, by forming both the inner layer and the respective outer layers of a glass material, embodiments of the invention provide a match between the coefficients of thermal expansion among the various layers. This arrangement limits warping and other distortions typically introduced at elevated bonding temperatures.

Embodiments of the invention enable high precision formation of ink printheads via forming an outer glass layer including its own first fluid flow structure separately from the formation of an inner glass layer with a second fluid flow structure. These embodiments also improve the matching of materials of adjacent layers to reduce undesirable effects from the adjacent layers having different coefficient thermal expansion.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. An ink printhead prepared by the process comprising:

forming, as a single piece, an inner glass layer including a first side and a second side opposite the first side with each respective first side and second side comprising an array of fluid ejection units, each fluid ejection unit including a first nozzle portion and a firing chamber with the firing chamber aligned with, and in fluid communication with, the first nozzle portion, the respective fluid ejection units laterally spaced apart from each in a first direction;

forming each of a first outer glass layer and a second outer glass layer as a single piece, with each respective first and second outer glass layer including a first side and a second side, the second side comprising an array of second nozzle portions laterally spaced apart from each other in the first direction with each respective second nozzle portion configured for reciprocally engaging the first nozzle portions of the respective first and second sides of the inner glass layer to define a nozzle of each respective fluid ejection unit; and bonding the inner glass layer in a sandwiched position between the respective first and second outer glass layers to align the respective second nozzle portions of the respective outer glass layers with, and be in fluid communication with, the respective first nozzle portions of the inner glass layer to define fluid ejection units on each of the opposite first and second sides of the inner glass layer.

2. A fluid ejection device prepared by the process of claim 1.

3. The fluid ejection device of claim 2 wherein the fluid ejection device comprises a side shooter-type ink printhead.

4. The ink printhead prepared by the process of claim 1, comprising:

forming a first back-flow restrictor portion on the second side of the respective outer glass layers and a second back-flow restrictor portion on the respective first and second sides of the inner glass layer, with the first back-flow restrictor portion being in vertical alignment with the second back flow restrictor portion to define a back-flow restrictor between the firing chamber and an ink flow channel located on an opposite side of the back-flow restrictor relative to the firing chamber.

5. The ink printhead prepared by the process of claim 1 wherein forming the inner glass layer comprises:

forming the single piece to include at least one particle filter on the first side of the inner glass layer with the at least one particle filter longitudinally spaced apart from the respective first nozzle portion and the respective firing chamber of the inner glass layer, wherein forming at least one particle filter comprises forming an array of columns extending upward from the respective sides of the inner glass layer with the columns being both laterally spaced apart from each other in the first direction and longitudinally spaced apart from each other in the second direction.

6. The ink printhead prepared by the process of claim 1 and further comprising:

bonding a piezoelectric driver to the first side of each respective outer layer with the piezoelectric driver being generally vertically aligned above the respective firing chamber.

7. A fluid ejection printhead comprising:

a pair of outer glass layers with each outer glass layer including a first side and a second side, the second side defining at least one first nozzle portion; and an inner glass layer sandwiched between, and bonded relative to, the respective outer glass layers, the inner glass layer including a first side and a second side opposite the first side, with each respective first side and second side defining at least one firing chamber aligned with, and in fluid communication with, the at least one first nozzle portion of the respective outer glass layers to define at least one fluid ejection unit on each of the opposite first and second sides of the inner glass layer.

8. The fluid ejection device of claim 7, wherein each opposite side of the inner glass layer comprises at least one ink feed channel longitudinally spaced apart from the at least one firing chamber and in fluid communication with the at least one firing chamber, and each first and second side of the inner glass layer comprises a particle filter positioned in at least one of the at least one firing chamber and at least one ink feed channel, wherein the particle filter defines an array of protrusions extending upward from a generally flat portion of the respective first and second sides of the inner glass layer, and wherein the respective protrusions are longitudinally spaced from each other in a first direction and laterally spaced from each other in a second direction.

9. The fluid ejection device of claim 7, wherein each first and second side of the inner glass layer comprises at least one second nozzle portion in fluid communication with the at least one first nozzle portion, the at least one second nozzle portion is in fluid communication with the at least one firing chamber and vertically aligned with the at least one first nozzle portion of the respective outer glass layers, and wherein the at least one first nozzle portion of the respective outer glass layers defines a first protrusion extending outward from a generally flat portion of the respective outer glass layers toward the at least one second nozzle portion of the inner glass layer to reciprocally engage the at least one second nozzle portion to define at least one integrated nozzle of the fluid ejection device.

10. The fluid ejection device of claim 7, wherein the at least one fluid ejection unit comprises a back-flow restrictor including:

at least one second protrusion of the respective outer glass layers extending generally outward toward the respective first and second sides of the inner glass layer, the second protrusion positioned between, and longitudinally spaced apart from, the at least one firing chamber and the at least one ink feed channel; and at least one third protrusion of each first and second side of the inner glass layer extending generally outward toward, and vertically aligned with, the at least one second protrusion of the respective outer glass layers.

11. The fluid ejection printhead of claim 7, wherein the inner glass layer is formed as a single piece.

12. A fluid ejection printhead comprising:

a pair of outer glass layers with each outer glass layer including a first side and a second side, the second side defining at least one first nozzle portion; and an inner glass layer sandwiched between, and bonded relative to, the respective outer glass layers, the inner glass layer including a first side and a second side opposite the first side, with each respective first side and second side defining at least one firing chamber aligned with, and in fluid communication with, the at least one first nozzle portion of the respective outer glass layers to define at least one fluid ejection unit, wherein each opposite first and second side of the inner glass layer comprises at least one ink feed channel longitudinally spaced apart from the at least one firing chamber and in fluid communication with the at least one firing chamber, and each first and second side of the inner glass layer comprises a particle filter positioned in at least one of the at least one firing chamber and at least one ink feed channel, wherein the particle filter defines an array of protrusions extending upward from a generally flat portion of the respective first and second sides of the inner glass layer, and wherein the respective protrusions are longitudinally spaced from each other in a first direction and laterally spaced from each other in a second direction.

13. A fluid ejection printhead comprising:

a pair of outer glass layers with each outer glass layer including a first side and a second side, the second side defining at least one first nozzle portion; and an inner glass layer sandwiched between, and bonded relative to, the respective outer glass layers, the inner glass layer including a first side and a second side opposite the first side, with each respective first side and second side defining at least one firing chamber aligned with, and in fluid communication with, the at least one first nozzle portion of the respective outer glass layers to define at least one fluid ejection unit, wherein each opposite first and second side of the inner glass layer comprises at least one second nozzle portion in fluid communication with the at least one first nozzle portion, the at least one second nozzle portion is in fluid communication with the at least one firing chamber and vertically aligned with the at least one first nozzle portion of the respective outer glass layers, and wherein the at least one first nozzle portion of the respective outer glass layers defines a first protrusion extending outward from a generally flat portion of the respective outer glass layers toward the at least one second nozzle portion of the inner glass layer to reciprocally engage the at least one second nozzle portion to define at least one integrated nozzle of the fluid ejection device.

14. A fluid ejection printhead comprising:

a pair of outer glass layers with each outer glass layer including a first side and a second side, the second side defining at least one first nozzle portion; and an inner glass layer sandwiched between, and bonded relative to, the respective outer glass layers, the inner glass layer including a first side and a second side opposite the first side, with each respective first side and second side defining at least one firing chamber aligned with, and in fluid communication with, the at least one first nozzle portion of the respective outer glass layers to define at least one fluid ejection unit, wherein the at least one fluid ejection unit comprises a back-flow restrictor including:

at least one first protrusion of the second side of each respective outer glass layer extending generally outward toward the respective first and second sides of the inner glass layer, the at least one first protrusion positioned between, and longitudinally spaced apart from, the at least one firing chamber and the at least one ink feed channel; and at least one second protrusion of each first and second side of the inner glass layer extending generally outward toward, and vertically aligned with, the at least one first protrusion of the second side of each respective outer glass layer.

* * * * *